US006659201B2

(12) United States Patent
Head et al.

(10) Patent No.: US 6,659,201 B2
(45) Date of Patent: Dec. 9, 2003

(54) METHOD AND APPARATUS FOR DIRECTIONAL ACTUATION

(75) Inventors: Philip Head, Ascot (GB); Mike Yuratich, Southhampton (GB)

(73) Assignees: TSL Technology, Southampton (GB); XL Technology Limited, London (GB)

( * ) Notice: Subject to any disclaimer, the term of this patent is extended or adjusted under 35 U.S.C. 154(b) by 0 days.

(21) Appl. No.: 09/881,652

(22) Filed: Jun. 14, 2001

(65) Prior Publication Data

US 2002/0007969 A1 Jan. 24, 2002

(30) Foreign Application Priority Data

Jun. 16, 2000 (GB) ..... 0014802
Mar. 15, 2001 (GB) ..... 0106368

(51) Int. Cl.[7] ..... E21B 7/06
(52) U.S. Cl. ..... 175/61; 175/74
(58) Field of Search ..... 175/61, 62, 73, 175/74, 75, 76

(56) References Cited

U.S. PATENT DOCUMENTS 3,935,642 A * 2/1976 Russell ..... 33/302
5,775,444 A * 7/1998 Falgout, Sr. ..... 175/322
5,875,859 A * 3/1999 Ikeda et al. ..... 175/73
6,082,470 A * 7/2000 Webb et al. ..... 175/45
2001/0022241 A1 * 9/2001 Portman et al. ..... 175/61

* cited by examiner

*Primary Examiner*—William Neuder
(74) *Attorney, Agent, or Firm*—Herbert Dubno

(57) ABSTRACT

A variable orientation downhole actuation tool is made up of a first part which is adapted to be fixed with respect to the end of a down hole tube, and a second part which is adjustable with respect to the first part. The first and second parts are adjustable with respect to each other in any two of the three Euler angles possible angles, that is, the included angle or bend of a respective reference axis, the plane of included angle, or direction, and the rotation of the first body about its reference axis. It may also include a third part such that the third part is adjusted by at least one of the possible angles with respect to the second part, and the second part is adjusted by a further of the possible angles with respect to the first part. A passageway is provided between the first and second parts for the conveyance of material, gas, liquid, solid or some combination. A joint is provided for coupling the first part to the second part, said joint permitting the said adjustment of the first part with respect to the second part.

11 Claims, 9 Drawing Sheets

Section X
Section X
201
202
204
205
206
207
208
211
219
220

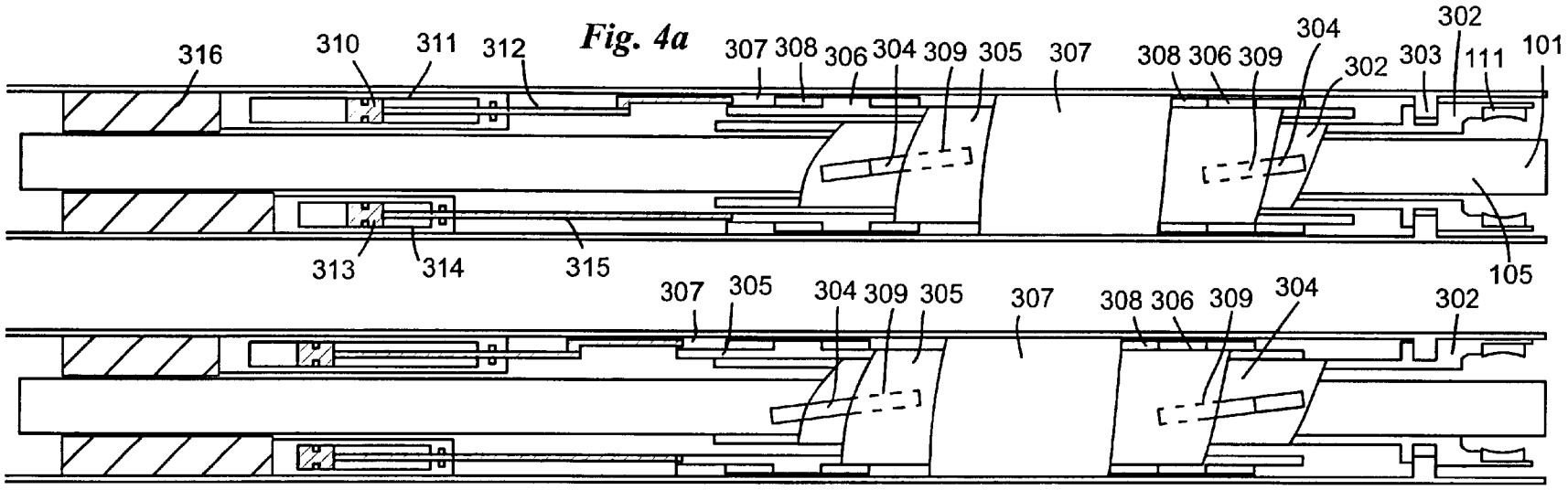
Fig. 4a
Fig. 4b
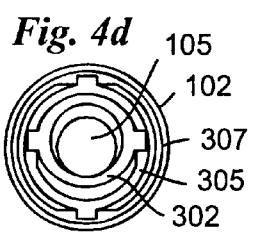
Fig. 4d
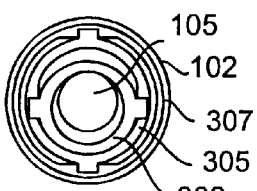
Fig. 4e
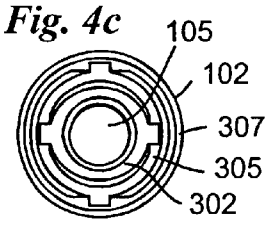
Fig. 4c
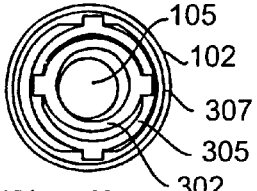
Fig. 4h
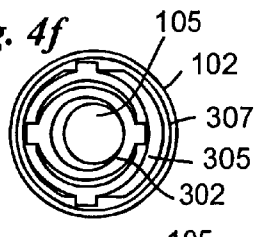
Fig. 4f
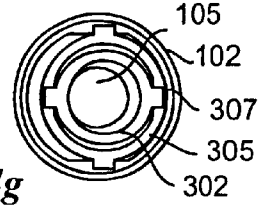
Fig. 4g

METHOD AND APPARATUS FOR DIRECTIONAL ACTUATION

FIELD OF THE INVENTION

This invention relates to directional drilling tools. In particular, the invention relates to directional drilling tools which are used to control the direction of drilling of bore holes.

BACKGROUND OF THE INVENTION

Changes in the direction of drilling of bore holes are required for a number of reasons. The most frequent reason is to change from vertical drilling to horizontal drilling or drilling at any particular angle other than vertical. Horizontal drilling has been known for many years and there are a number of established methods of changing the direction from vertical drilling to horizontal drilling. For example long radius drilling which is used for accessing oil reservoirs in remote locations, under cities, offshore or to avoid geological isolation.

Medium radius drilling is used for pinnacle relief, fractured formations and gas and water coning. Short radius drilling can be used for all these applications. The particular method used is chosen based on the economic considerations of the particular well.

The most common existing method to change the direction of drilling is to use a bent support for the drill bit or a "bent sub" as it is often referred to. Typically a drill bit is used which is powered by a motor and the bent sub is positioned behind the motor. It is also possible for the bent sub to be positioned in front of the motor. The bent sub effectively causes the axis of rotation of the drill to be at a different angle to that of the drill pipe. Continuous drilling with the bent sub causes continuous changes of direction which results in a curved well hole in the direction of the bend of the bent sub. When the required curvature has been achieved drilling can be stopped and the bent sub changed for a straight sub to resume straight drilling.

Alternatively, the entire drill pipe can be rotated at the surface resulting in a small rotation of the bent sub, motor and drill bit assembly. The bend of the bent sub is now positioned in a different direction and drilling can be resumed in this different direction.

Directional sensors such as gyroscopic sensors are used to check the progress and direction of the drilling to establish what adjustments to the drilling angle are required.

A disadvantage of this existing method of directional drilling is that the drilling tool has to be removed from the bore hole and changed before drilling in the straight direction can be recommenced. This results in an expensive operation and increases the time to complete the required drilling.

A further disadvantage is that when drilling is restarted in a new direction it is often the case that the drill bit kicks in an unpredictable direction due to unevenness in the hardness of the formation at the point of stoppage of the drill head.

A further disadvantage with this known method is that control of the direction of the drill bit is inaccurate because it relies on rotation of the whole of the drill pipe which can result in unpredictable degrees of rotation of the drill bit. Furthermore in some applications such as with the use of continuous drill pipe or coiled tubing it is not practical to rotate the drill pipe.

GB-A-2271795 relates to a directional drilling tool in which a drill bit support is arranged upon a main support by means of a cam surface such that rotating of the drill bit support with respect to the main support cause the drill bit support to be oriented in a different direction. A disadvantage of this tool however is that the angle of the drilling tool is fixed by the shape of the cam profile which is preset and can not be changes during the drilling process, without coming back out and re-fitting an alternative tool with a different cam profile. This limits the flexibility of the drilling process.

It is an objective of this invention to provide a means of conveniently adjusting the orientation of a down hole actuation tool.

SUMMARY OF THE INVENTION

According to the present invention there is provided a variable orientation downhole actuation tool comprising a first part which is adapted to be fixed with respect to the end of a down hole tube and a second part which is adjustable with respect to the first part, characterized in that the first and second parts are adjustable with respect to each other in any two of the three possible angles; said three possible angles being the so-called Euler angles, namely the included angle or bend of a respective reference axis, the plane of included angle, or direction, and the rotation of the first body about its reference axis.

Preferably the comprises a third part such that the said third part is adjusted by at least one of the possible angles with respect to the second part which second part is adjusted by a further of the possible angles with respect to the first part.

Preferably a passageway is provided between the first and second parts for the conveyance of material, gas, liquid, solid or a combination thereof.

According to another aspect of the present invention there is provided a variable orientation downhole actuation tool comprising a first part which is adapted to be fixed with respect to the end of a down hole tube and a second part whose orientation is adjustable with respect to the characterized in that the first part and the second part includes at least one cammed surface and at least one corresponding cam follower respectively, the cammed surface being at an inclination to the second part's axis, such that movement of the cam follower relative to the cammed surface causes a change of inclination of the second part relative to the first part.

Preferably the first part and the second part includes a first and a second cammed surface and a first and a second corresponding cam follower respectively, relative movement of the first cammed surface and first cam follower causing a change of inclination of the second part relative to the first part in a first plane, relative movement of the second cammed surface and second cam follower causing a change of inclination of the second part relative to the first part in a second plane different to the first plane.

According to a further aspect of the present invention there is provided a variable orientation downhole actuation tool comprising a first part which is adapted to be fixed with respect to the end of a down hole tube and a second part whose orientation is adjustable about a pivot means with respect to the first part characterized in that the first part includes a moveable bearing surface and the second part includes a corresponding bearing the bearing surface and bearing being moveable in two orthogonal planes such that the second part may be pivoted about the pivot means in two orthogonal planes in respect of the first part.

Preferably the first and second parts include engaging means that allow torque to be transmitted from the first part to the second part.

According to another aspect of the present invention there is provided a method of forming windows in borehole casings by means of a variable orientation downhole window forming tool comprising a first part which is fixed with respect to the end of a down hole tube and a second part which is adjustable with respect to the first part, characterized in that the forming tool is run in hole with a closely fitting straight orientation and then a bend is set to bring the window forming tool into contact with the casing upon further advancement of the window forming tool.

By embodiments of the invention efficient means of fast rotation and transmission of high torque of one of the first and second parts relative to the other are provided.

Also, strong means of coupling one of the first and second parts to the other member to another to resist reaction forces is provided.

It is a further aspect of this invention to provide means of supplying mechanical rotary power to an assembly on the actuation tool.

The actuation tool of the invention may also be used for milling windows in casing that lines a previously drilled borehole. Diameter is a severe constraint and by means of the invention it is possible to run in hole with a closely fitting straight assembly and then to set a bend to bring the cutter into contact with the casing.

Furthermore, in order to make a rapid change in direction in a short drilled distance, it is advantageous that the bend must be close to the bit, while the bit must be supported by a robust thrust bearing to permit motor shaft rotation under heavy loads. It is also advantageous that a short and simple bottom hole assembly is likely to be much more reliable and much more easily integrated with instrumentation and surface handling equipment. The present invention further provides an adjustable bend, adjustable plane of bend, thrust bearing, rotating motor shaft and passage for drilling fluid in one integrated joint close to the bit.

It will be evident that the invention may be used for pointing without necessarily rotating, such as without limitation for directing a fluid or plasma or other cutting or welding jet, arc or implement. It may also without limitation be used for orbiting a rotating abrasive or cleaning head for cleaning, cutting or dressing casing and casing joints or for expanding casing by orbiting side force.

BRIEF DESCRIPTION OF THE DRAWINGS

The following is a more detailed description of an embodiment of the invention by way of example only and not intended to be limiting, reference being made to the accompanying drawings, in which:

FIG. 4A shows a longitudinal section of a third embodiment of the downhole actuation tool with a dual parallel translating actuator for adjusting a lever, deployed at a straight position;

FIG. 4B shows a longitudinal section of a third embodiment of the downhole actuation tool with a dual parallel translating actuator for adjusting a lever, deployed at maximum upwards offset position;

FIG. 4C shows a transverse section of a third embodiment of the downhole actuation tool with a dual parallel translating actuator for adjusting a lever, deployed at a straight position;

FIG. 4D shows a transverse section of a third embodiment of the downhole actuation tool with a dual parallel translating actuator for adjusting a lever, deployed at maximum upwards offset position;

FIG. 4E shows a transverse section of a third embodiment of the downhole actuation tool with a dual parallel translating actuator for adjusting a lever, deployed at maximum downwards offset position;

FIG. 4F shows a transverse section of a third embodiment of the downhole actuation tool with a dual parallel translating actuator for adjusting a lever, deployed at maximum leftwards offset position;

FIG. 4G shows a transverse section of a third embodiment of the downhole actuation tool with a dual parallel translating actuator for adjusting a lever, deployed at maximum rightwards offset position;

FIG. 4H shows a transverse section of a third embodiment of the downhole actuation tool with a dual parallel translating actuator for adjusting a lever, deployed at a combined intermediate upwards and rightwards offset position.

The invention will now be described with reference to the representative embodiments in the figures. It will be understood that many features of engineering practice such as seals, fastenings, and bearings may be changed according to preference and physical size of the apparatus without altering the invention.

DESCRIPTION OF THE PREFERRED EMBODIMENT

Detailed embodiments of the invention of a variable orientation downhole actuation tool will now be described comprising a first part which is fixed with respect to the end of a down hole tube and a second part which is adjustable with respect to the first part. The first and second parts are adjustable with respect to each other in any two of the three possible angles. The said three possible angles are the so-called Euler angles, namely the included angle or bend of a respective reference axis, the plane of included angle, or direction, and the rotation of the first body about its reference axis.

Figure 1:
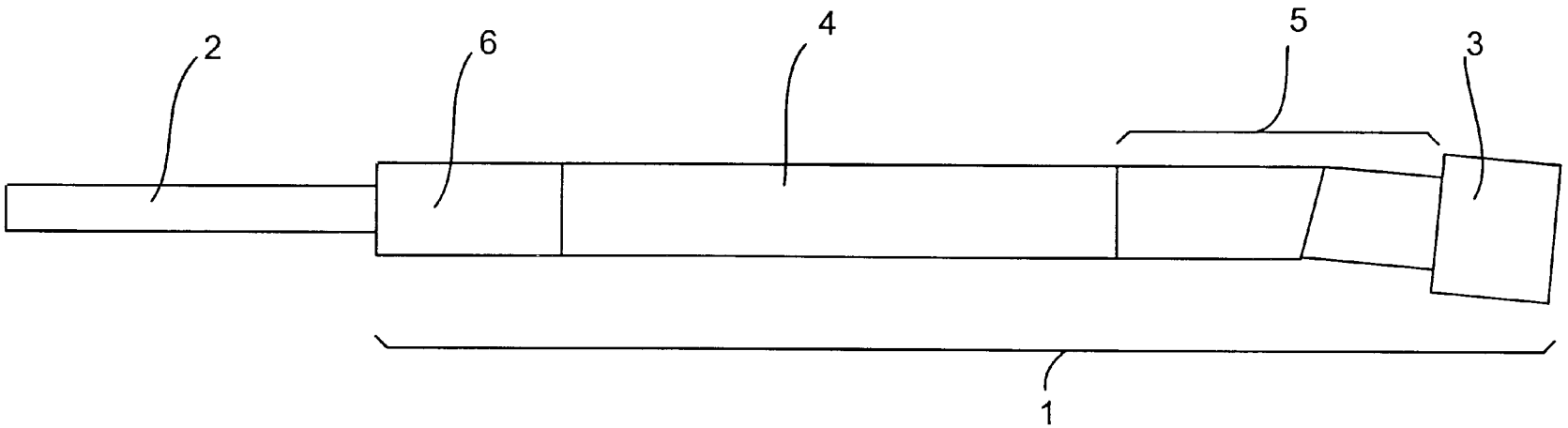
FIG. 1 shows a longitudinal cross-section of a drilling assembly according to the invention in a first orientation.

Referring firstly to FIG. 1, the representative directional drilling tool 1 in accordance with the invention comprises a bottom hole assembly connected to the drill pipe 2. The bottom hole assembly comprises an instrumentation sub 6 and drill bit 3 that is powered by motor 4 via an internal shaft not shown running through the orientation sub 5. The drill pipe 2 referred to throughout this specification can either be conventional drill pipe comprising sections connected together or alternatively, and preferably to achieve the full advantages of the present invention, a continuous coiled tubing type drill pipe. Further details of the bottom hole assembly well-known in the art such as weak-point connector are not shown. Power for the orientation sub 5 may be supplied by batteries in instrumentation sub, by direct cable connection to surface or by downhole generation means such as turbine alternators known in the art. Instrument sub 6 may also carry sensors to provide feedback information to control the orientation sub 5. It will be understood that the invention does not depend on the precise location of said instrumentation, which might be also be placed close to the point of drilling between drill bit 3 and orientation sub 5, or made integral with orientation sub 5. Preferably the orientation sub 5 will be placed below the motor 4 in order to maximize its influence on steering, but it is also possible to position it between drill pipe 2 and motor 4.

FIG. 1 depicts the orientation sub 5 with a bend in the plane of the paper. When the bend is reduced to zero the drilling assembly becomes straight and drilling will be in line with the drill pipe.

It will be appreciated that it is desirable to adjust in the plane of the paper of FIG. 1 being the vertical plane to achieve changes in the build or drop angle and it is also desirable to adjust in the plane orthogonal to the plane of the paper in FIG. 1 being the horizontal plane to achieve changes in the azimuth angle. Vertical and horizontal adjustments may be combined as will become apparent from the following description. Vertical and horizontal reference planes are being used for convenience of description but any preferably orthogonal planes can be used. During drilling, twisting in the bottom hole assembly and drill pipe will cause these planes to vary, necessitating the use of downhole angular sensors such as accelerometers and magnetometers well known in the art to measure orientation. The severity of steering may be controlled by the amount of bend.

Housing 101 in FIG. 2 is a continuation of the drillpipe and motor assemblies and will be considered as a fixed reference for the purpose of description, without affecting the generality of application of the invention. Drill bit 102 is assembled into bit box crossover 103 and thence to hollow steering shaft 104, by tapered threaded joints for stiffness and strength. Shaft 104 may be keyed on its internal bore to receive a tool whereby it may be tightened to cross-over 103 without adding length to the shaft for external gripping tongs.

The limited-angle split spherical plain bearing 108, similar to commercial products, is set into housing 101, retained by shoulder 131, spacer 109 and nut 110. The inner rings of this bearing 138 capture the steering shaft on flange 164 and provide massive and stable support for thrust loads, side loads and extraction loads that may be reacted into the shaft from the drill bit. The spherical bearing defines a center 118 about which the steering shaft is constrained to pivot in any direction. By making the steering shaft from strong bearing material such as Beryllium Copper alloy it is free to rotate about its longitudinal axis, journalled in the spherical bearing ring internal mounting faces 168. This free rotation avoids premature wear of bearing 108 that would otherwise be caused if ring 138 was required to rotate within it at fast motor speed, and permits the addition of a peg or similar means between the parts of the bearing to prevent such rotation.

Motor shaft 105 is rotated by the drilling motor and has cut onto it a so-called crown spline 107. This spline engages in straight splines 134 cut in the bore of the steering shaft. As is well known a crown spline coupling provides a means of transmitting torque through shafts at small angles to each other.

Motor shaft 105 may be assembled to steering shaft 104 by various means according to required strength and space availability. In the embodiment shown the spline is too large to insert from one end of the steering shaft, which is accordingly shown in two parts screwed together to act as a single stiff whole.

Preferably as show n the steering shaft rotates directly within the bearings to minimize the size and number of parts in the assembly. If space permits, separate bushings and even needle or other bearing means may be used to support the rotating steering shaft in its spherical bearing.

From the foregoing description it can now be readily appreciated that the drill bit 102 can be pointed in any direction within the limits of the spherical bearing 108 and crown spline 107, by tilting the steering shaft 104, and that at any such direction the motor shaft 105 will rotationally drive the drill bit.

It is a feature of the embodiment that the motor shaft runs centered and concentric to the housing centerline, making it balanced and easy to support in bearings. The crown spline coupling-inherently provides lateral support for the lower end of motor shaft and this may be sufficient in many applications. The motor end of the shaft and its sealing arrangements are not shown as they may be by any convenient well known means.

This embodiment is preferred in that the distance between bit and center 118 is short, so only a modest angle of tilt, typically 2 degrees, suffices to achieve a high rate of turn of the borehole. Moreover this short distance and small angle mean that forces reacted back to the distal end 164 of the steering shaft are manageable.

Again referring to FIG. 2, a second spherical bearing 111 is shown on the end of the steering shaft near 164. Representatively this is shown as a non-split bearing of commercial type. The steering shaft turns freely within the inner bearing ring 141. Continuous rotation of 141 within 111 is unnecessary and may be prevented by a key to prevent premature wear. Tilting of the steering shaft may thus be accomplished by displacing bearing 111 transversely from the center line in any direction.

Housing 119 holds bearing 111 and suitable means of displacement will be disclosed below.

Figures 2A, 2B:
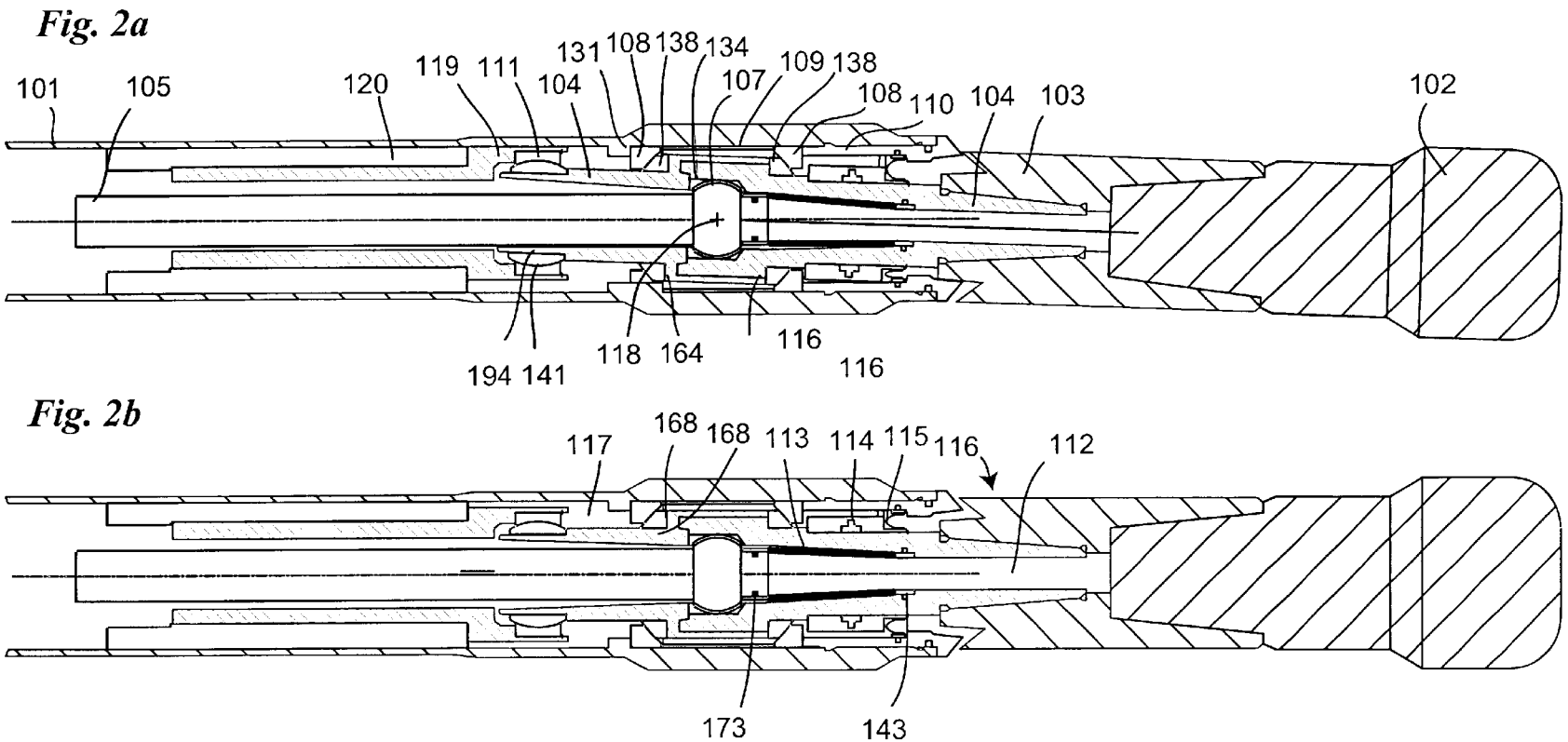
FIG. 2A shows a longitudinal section of a first embodiment of the downhole actuation tool with an integrated steering joint in a bent position.
FIG. 2B shows a longitudinal section of a first embodiment of the downhole actuation tool with an integrated steering joint in a straight position.

Moving 111 upwards in the plane of the paper results in the bend as shown in FIG. 2A. Moving down in the plane of the paper to the limits of the assembly and housing sets the bend to a similar angle but in a direction 180 degrees opposed about the housing 101 axis. Moving to set the bearing centered on the axis of the housing leaves the bend straight, as shown in FIG. 2B. It will be appreciated that moving the bearing out of the plane of the paper and up and down allows all directions 0–360 degrees and all bends from zero to the aforementioned practical limit to be reached.

Moving the center of bearing 111 on a fixed radius circle from housing 101's centerline causes the bit to be pointed at a fixed bend in all directions. Thus, importantly, a complete circular traverse of the bearing center causes a complete circle of bit direction, but not a rotation of the bit. Bit rotation is effected by turning the motor shaft 105. If the motor shaft did not rotate then the bit would be seen to deflect in different directions but a point marked on it would not rotate. Conversely an actuator acting on housing 119 may rotate in a complete circle to cause the bearing 111 center to traverse. Actuator rotation is decoupled from the steering shaft by bearing 111, so does not cause the steering shaft or bit thereon to rotate.

The embodiments of the present invention, with the single center 118 of deflection and torque transmission through the center, are completely different from a system in which there is a fixed bend which is rotated distant from the bend center. If the motor shaft was passed through the bend direct to the bit then the bit would require its own bearings and a lower housing. The motor shaft would need to be deflected through the bend axis, or split and coupled. If it was split and coupled at the center of the steering joint then the joint would be weakened by the need to house a non-integral coupling. If the shaft was split into one or more lengths so as to pass through the constriction of the steering joint center then additional couplings, possible off center to the housing would be required and this is difficult to accomplish reliably.

When bearing 111 is moved transversely, its relative axial position along the steering shaft will vary slightly, as the steering shaft end describes an arc. This slight movement is easily accommodated by allowing the bearing ring 141 to slide along the shaft and/or the entire bearing 111 to slide within its housing 119.

A particular benefit of the spherical bearing 111 is that only side force can transmitted between the housing 119 and steering shaft 104, and not bending moment. This greatly reduces the strength needed for reliable operation and reduces flexure.

Motor shaft 105 is preferably tubular to permit the flow of drilling fluid or other substances or artifacts. Such a tubular bore is continued by bore 112 in the steering shaft and it is desirable to seal these elements together to prevent ingress into the mechanism of the joint. Importantly, as the two parts 104 and 105 are coupled by splines 134 they cannot rotate relative to each other. Therefore seal 113 representatively is drawn as an elastic tube sealed statically to the motor shaft at 143 and to the steering shaft at 173, and merely deflects as the bit is steered, as may be seen by comparing FIGS. 2A and 2B. In the normal case that the drilling fluid pressure greatly exceeds the internal pressure of the joint such as at 117, the seal is supported by its surrounding steering shaft bore. In the case that the drilling fluid pressure is less than the internal pressure of the joint, the seal may be prevented from collapse by reinforcement such as wire hoops or a loose steel liner tube.

The joint mechanism, if protected, must also be sealed to the outside of the housing. In this case, since steering shaft 104 rotates relative to housing 101 by virtue of being driven by the motor shaft, a rotary seal is required. Rotary seal 114 and ring gutter seal 115 are shown as a practical embodiment combining the performance of a pure rotary seal with the static deflection capability of the gutter seal, but it will be appreciated that many sealing arrangements are possible. The gutter seal accommodates deflection just as seal 113, and its action is evident by comparing FIGS. 2A and 2B, but it is shaped for the different deflection range and space available, and works best when the internal pressure 117 of the joint is reasonably balanced to the external pressure 116.

Figures 3A, 3B, 3C, 3D, 3E:
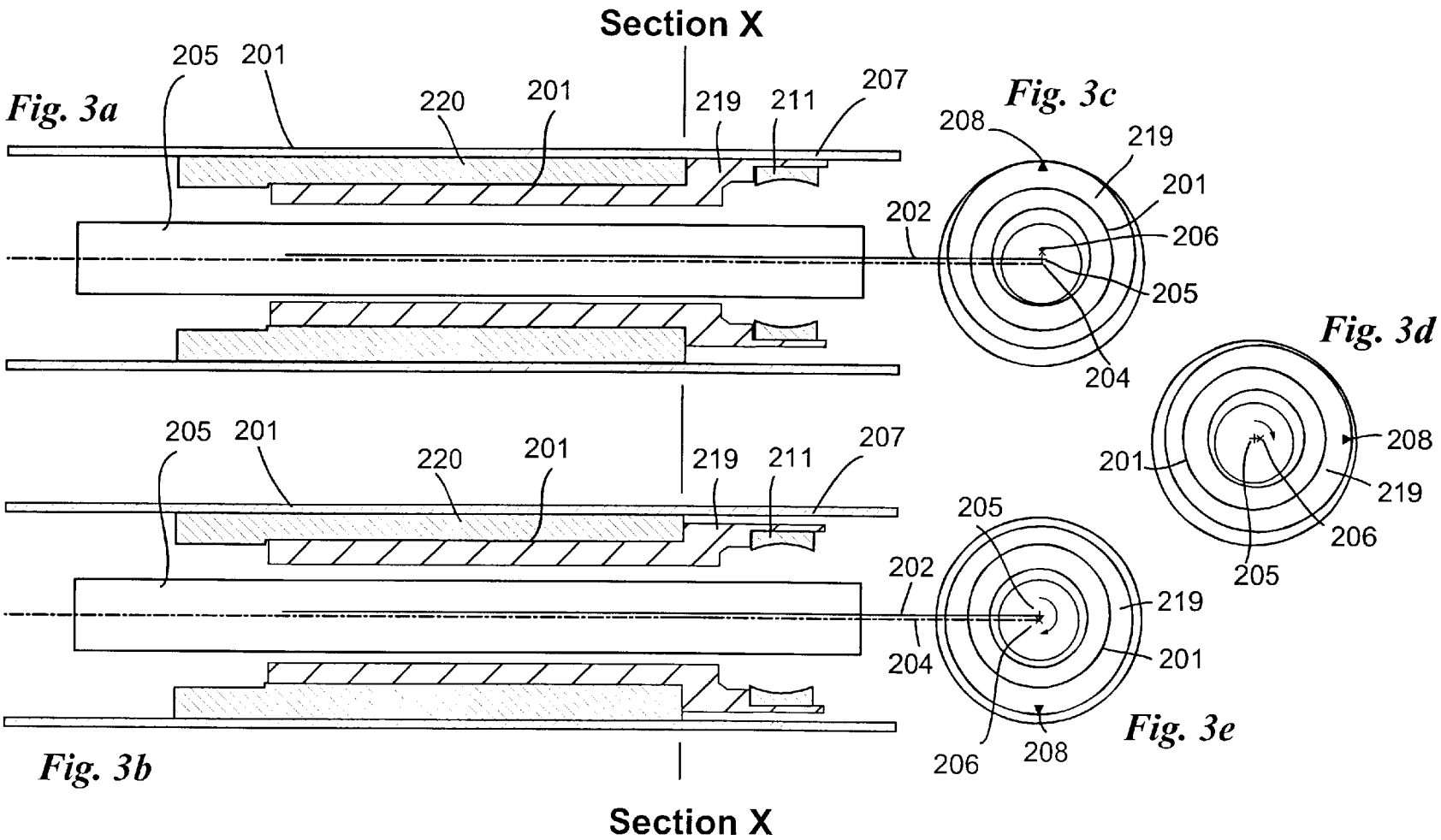
FIG. 3A shows a longitudinal section of a second embodiment of the downhole actuation tool with a dual parallel rotary actuator for adjusting a lever, deployed at a maximum offset position.
FIG. 3B shows a transverse section X of a second embodiment of the downhole actuation tool with a dual parallel rotary actuator for adjusting a lever, deployed at a straight position.
FIG. 3C shows a transverse section X of a second embodiment of the downhole actuation tool with a dual parallel rotary actuator for adjusting a lever, deployed at a maximum offset position.
FIG. 3D shows a transverse section X of a second embodiment of the downhole actuation tool with a dual parallel rotary actuator for adjusting a lever, deployed at an intermediate offset position.
FIG. 3E shows a transverse section X of a second embodiment of the downhole actuation tool with a dual parallel rotary actuator for adjusting a lever, deployed at a straight offset position.

Referring now to FIG. 3, a first means of controlling the steering shaft 104 will be disclosed. Bearing housing 119 is circular in cross-section and integral with an elongated inner cylindrical sleeve 201, which is free to rotate within an outer cylindrical sleeve 120. This outer sleeve is free to rotate within housing 101, and has center of rotation 204. Inner sleeve 201 rotates about its center 205. Housing 119 has center 206. Center 205 is displaced from center 204 by one half the maximum desired offset of housing 119. In FIG. 3A and FIG. 3C the inner and outer sleeves are shown rotated so that the offset is a maximum upwards in the plane of the paper. Accordingly the distances 205 to 206 and 204 to 205 are equal and a reference mark 208 on housing 119 is at its maximum distance from center 204.

If now the sleeve 201 is caused to rotate within sleeve 120, then center 206 will spiral towards center 204. FIG. 3D shows the inner sleeve rotate one-quarter turn. The reference mark has moved in direction but also is no longer at its maximum distance from center 204. After one half turn, center 206 is brought to coincide with center 204. FIGS. 3B and 3E show that housing 119, and hence bearing 111 now centers on the center line of the apparatus, 204.

The inner sleeve rotation may be continued onwards or reversed to bring housing 119 back to its starting position.

It will now be appreciated in comparison with FIGS. 3A and 3B that rotation of inner sleeve 201 provides a means to operate the steering joint continuously from maximum bend to straight.

At any intermediate rotation the offset of the steering shaft has been adjusted, but also its direction. The direction may now be brought to a desired position while keeping the offset fixed, by rotating outer sleeve 120 in housing 101 but keeping the relative rotation of inner sleeve 1 fixed relative to the outer sleeve.

It will now further be appreciated that by coordinating the rotations of the outer sleeve and the inner sleeve relative to the outer sleeve, any desired bend and direction of the steering joint may be obtained.

Many well-known methods of rotating the two sleeves and measuring their amount of rotation can be employed. Two are now briefly mentioned. Rotation can be from the output of a gearmotor, in which case, coupled with reversing of the motor, continuous adjustment will be obtained. Motor brakes can be used to lock the rotations. Alternatively a motor and screw, or hydraulics, can be used to reversibly longitudinally thrust a key, constrained not to rotate, along a screw thread cut in the sleeve to be rotated. The key's axial position thereby controls sleeve rotation. Motors can be individual units or, using clutches, the drilling motor shaft can be used as a source of power. Bend and direction angles can readily be calculated from the measured rotations and basic trigonometry.

FIG. 4 discloses a second means of controlling the steering shaft via bearing 111. Bearing housing 302 is a sleeve within an intermediate sleeve 305 and an outer sleeve 307. These sleeves are non-rotating. Housing 302 is axially constrained by a groove cut in it engaging in fixed ring 303. Housing 302 carries on it two diametrically opposed pairs of slanted keys 304. These keys engage in slots or grooves 309 cut in sleeve 305. The assembly may be made by pressing the keys into 302 via slots in 305. If sleeve 305 is forced forwards or backwards along the axis of the apparatus, then since inner sleeve 302 cannot move axially, the keys 304 fixed in it are forced to lift or lower 302 in the plane of the paper. FIGS. 4B and 4D show the inner sleeve 2 lifted as 305 and 307 are pulled together away from 303. FIG. 4E shows the inner sleeve 302 lowered as 305 and 307 are pushed together towards 303.

Intermediate sleeve 305 also carries two pairs of angled keys on it, 306, one quarter turn from slots 309. These keys engage in angled slots grooves cut in outer sleeve 307. The principle is identical to that of intermediate sleeve 305 and inner sleeve 302 already described except now that it will be apparent axial movement of the intermediate sleeve relative to the outer sleeve will cause transverse motion into and out of the plane of the drawing. FIG. 4F shows leftwards movement of the inner sleeve 302 when starting from FIGS. 4A and 4C, the outer sleeve is moved to a first axial extreme relative to the intermediate sleeve. Conversely FIG. 4G shows rightwards movement of the inner sleeve when the outer sleeve is moved to the opposite axial extreme relative to the intermediate sleeve.

It will now be readily appreciated that by coordinating the axial positions of the outer sleeve 307 and intermediate sleeve 305, the inner sleeve 302 and hence bearing 111 and hence the steering shaft may be made to move in any direction and offset from the apparatus center line. FIG. 4H shows such an intermediate position.

Axial movement of the sleeves may be achieved by many known methods, such as hydraulic cylinders 311 and 314. Bi-directional pistons 310 and 313 carry thrust/pull rods 312 and 315 connected to sleeves 307 and 305 respectively. These connections must allow for the small transverse movements of the sleeves. As an example, if the keys are set at a rate of one in eight, and the stroke length of cylinder 314 is plus or minus one inch, then it will cause a lift of inner sleeve 302 by plus or minus one-eighth inch. Since this axial motion is relative to outer sleeve 307, then cylinder 311 must have a stroke length of plus or minus two inches, to allow for its plus or minus one inch stroke to move inner sleeve sideways plus or minus one-eighth inch when cylinder 314 is at either end of its own stroke.

Figure 5:
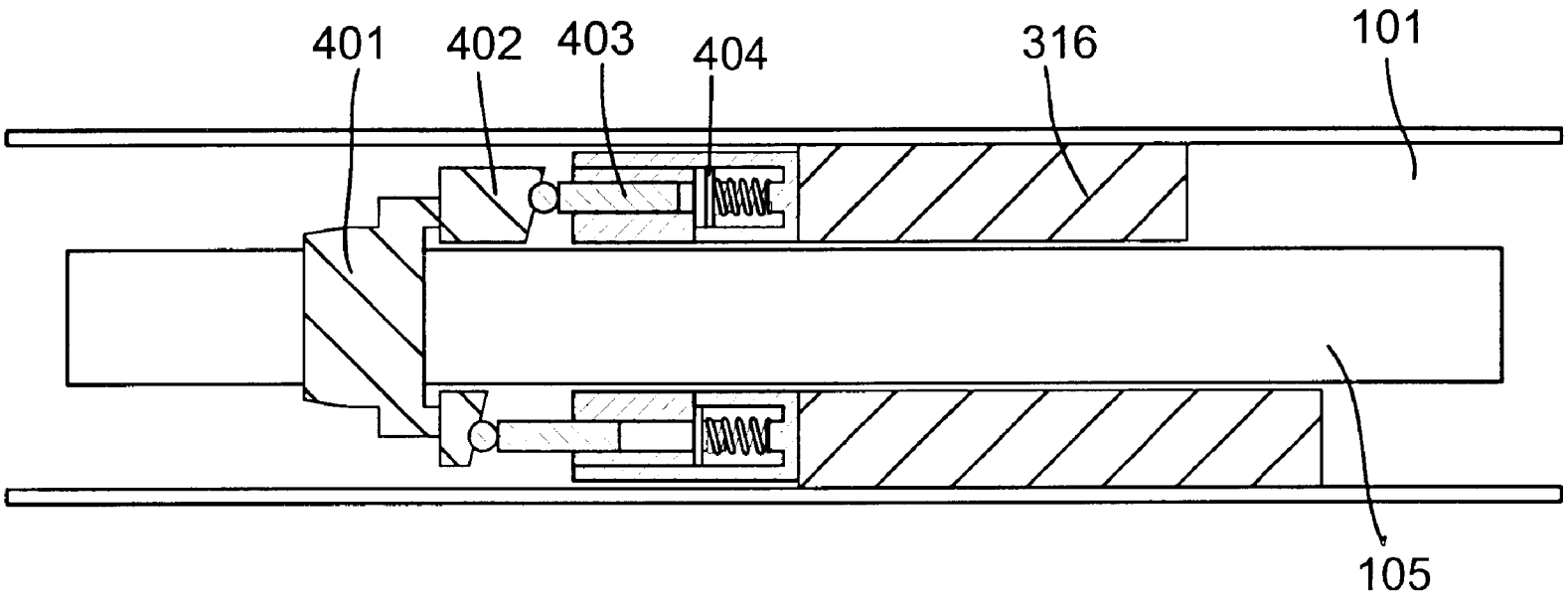
FIG. 5 shows a longitudinal section of a fourth embodiment of the downhole actuation tool with a hollow bore hydraulic actuator driven from a through motor shaft.

Hydraulic pistons may be operated via flow lines and remote pumps, or preferably using a local pump and valve assembly as representatively shown in FIG. 5. Here the drill motor rotation of motor shaft 105 is used via coupling 401 to turn an axial swash plate piston pump of well-known type, where 402 is the swash plate, 403 the pump pistons and 404 the pump valves. Cylinder operating valves may be fitted into annular valve block 316.

The embodiment in FIGS. 4 and 5 is readily varied according to requirements. For example, if the loads are relatively small then the fore and aft key pairs 304 and 306 may each be conveniently made as single elongate pairs. Cylinder 311 and piston 310 may be made the same stroke as 313 and 314, but 311 made slidable and locked to 315. The cylinders may be annular, or as shown divided into one or more small cylindrical units. Instead of keys and axial sleeve movement, the sleeves may be directly lifted relative to each other and housing 101 using transverse hydraulic cylinders.

It will also be appreciated that hybrid methods of control based on FIGS. 2 and 3 may be used. For example, sleeve 305 may be used to impart offset to sleeve 302 as already disclosed, but without keys 306, may be rotated like sleeve 120 to choose direction.

Figure 6:
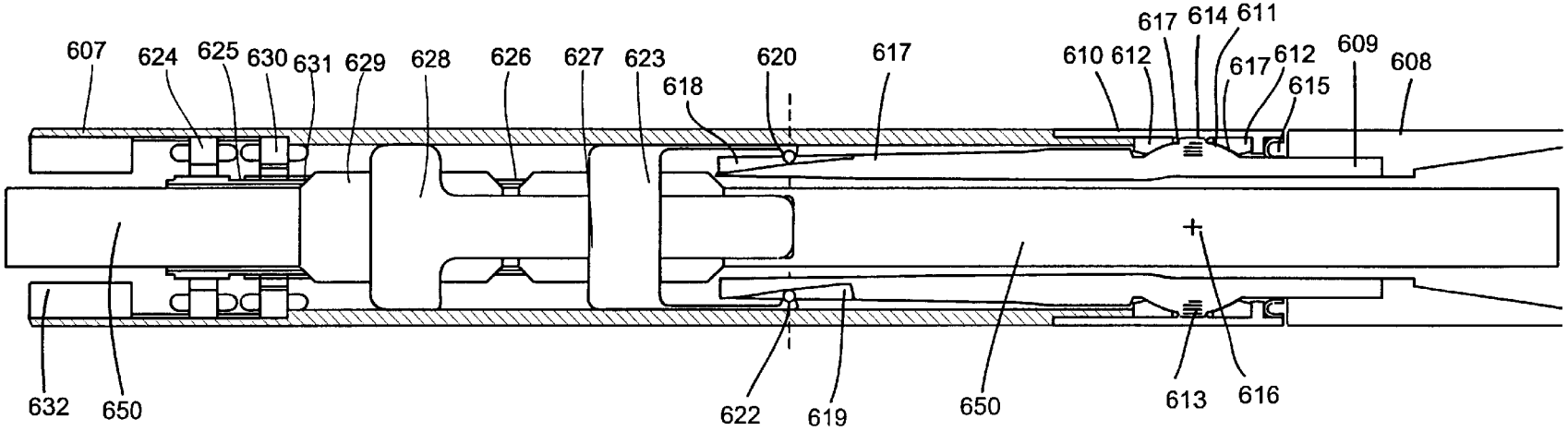
FIG. 6 shows a longitudinal cross-section of another embodiment of the orientation tool in a straight position.

Referring to FIG. 6, and alternative embodiment of the directional drilling tool comprises a first end 607 and a second end 608 said first end 607 being fixed with respect to motor 604 and said second end 608 being fixed in direction with respect to a drill bit 603. Protrusion 609 is fixed to second end 608, and retainer 610 is fixed to first end 607.

Protrusion 609 carries a spherical bearing surface 611, and retainer 610 holds mating rings 612, such that the first end 607 and second end 608 are held together and transmit axial compressive and tensile loads to each other while permitting free angular deflection between them. Protrusion 609 also carries crown spline teeth at 613 which engage in a straight spline at 614. These splines transmit torque between first end 607 and second end 608, so that the two may not rotate axially with respect to each other. Seal 615 provides a barrier between internal fluid in the invention and drilling fluid returning past its outer surface. This seal allows lateral movement of protrusion 609 and retainer 610. This description shows how a sealed coupling may be made between first end 607 and second end 608 that allows tilting in any direction but not relative axial rotation. Other methods may be used.

Protrusion 609 extends inside first end 607 so as to provide a lever arm pivoted on the center 616 of the spherical bearing surface 611. By deflecting the lever end 617 transverse to the axis of the first end 607, the second end 608 may be made to point in any direction about the axis of first end 607 and with a bend angle limited only by the mechanical proportions of the components.

Figure 7:
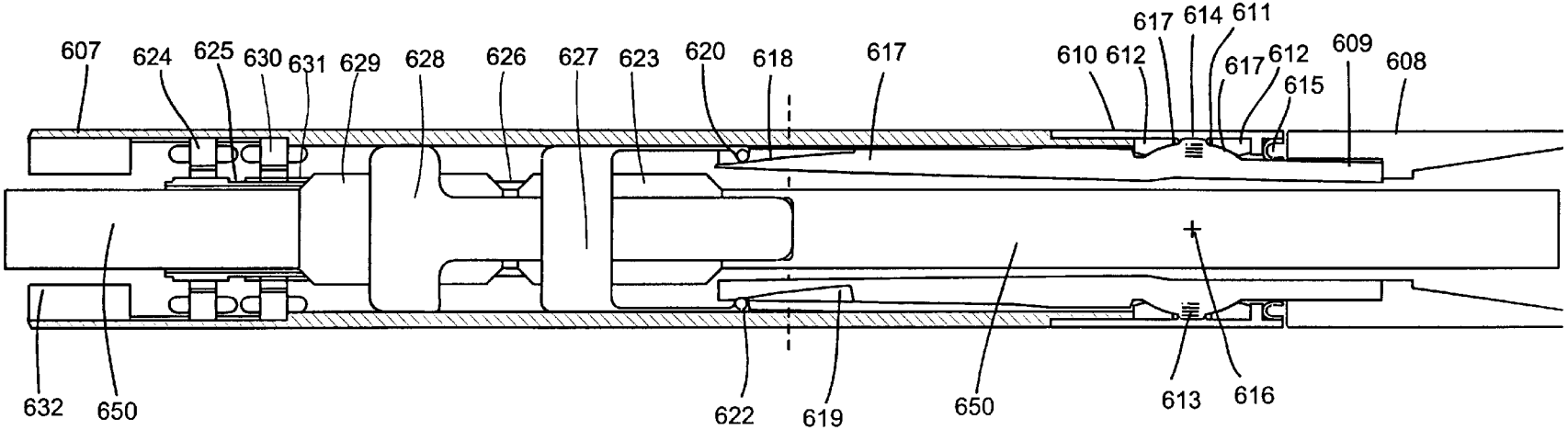
FIG. 7 shows a longitudinal cross-section of another embodiment of the orientation tool in a first orientation.
Figure 8:
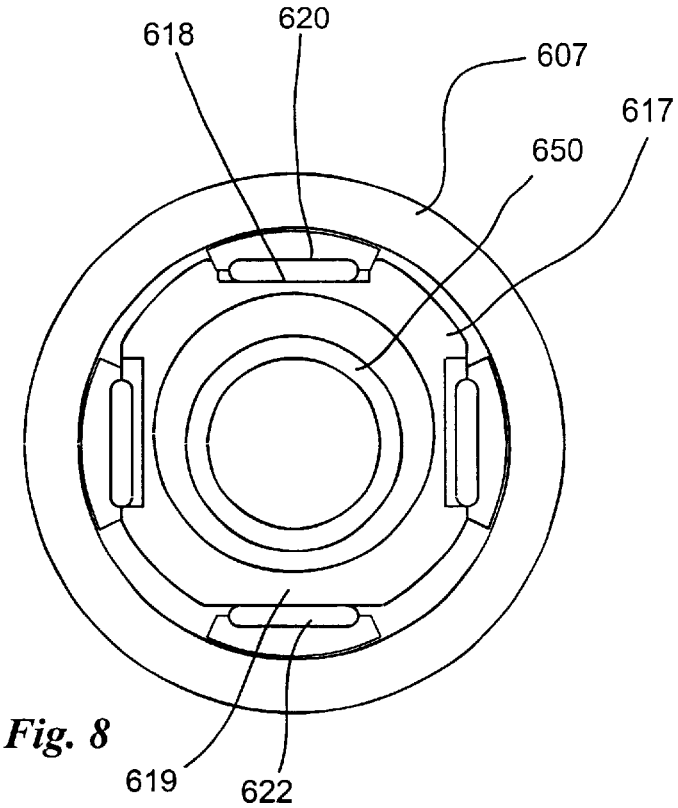
FIG. 8 shows an internal cross section of another embodiment of the orientation tool in a first orientation.
Figure 9:
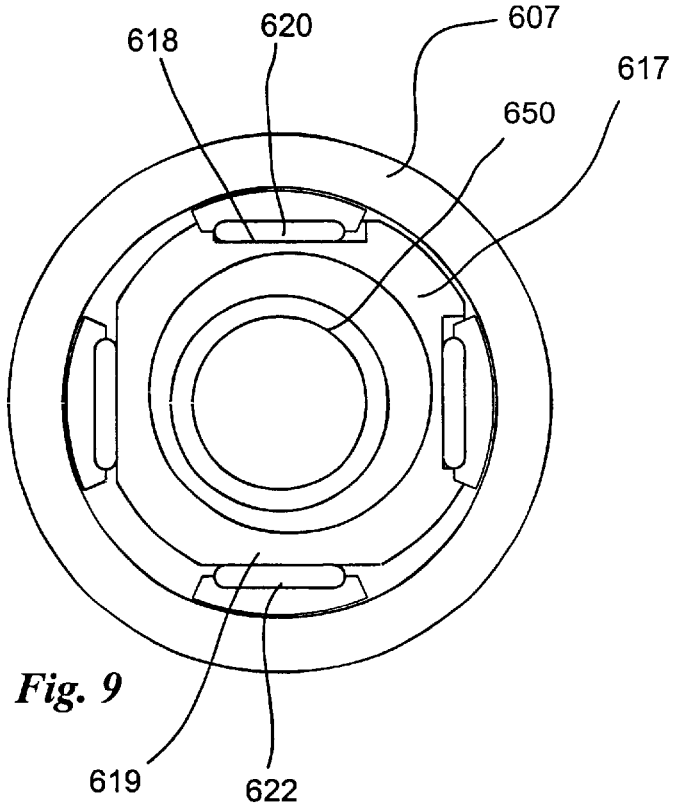
FIG. 9 shows an internal cross section of another embodiment of the orientation tool in a second orientation.
Figure 10:
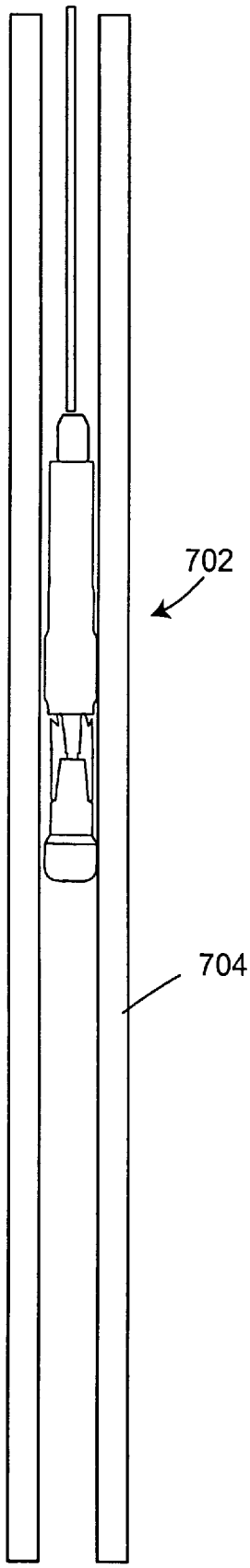
FIGS. 10 and 11 are diagrams illustrating the method aspect of the invention.
Figure 11:
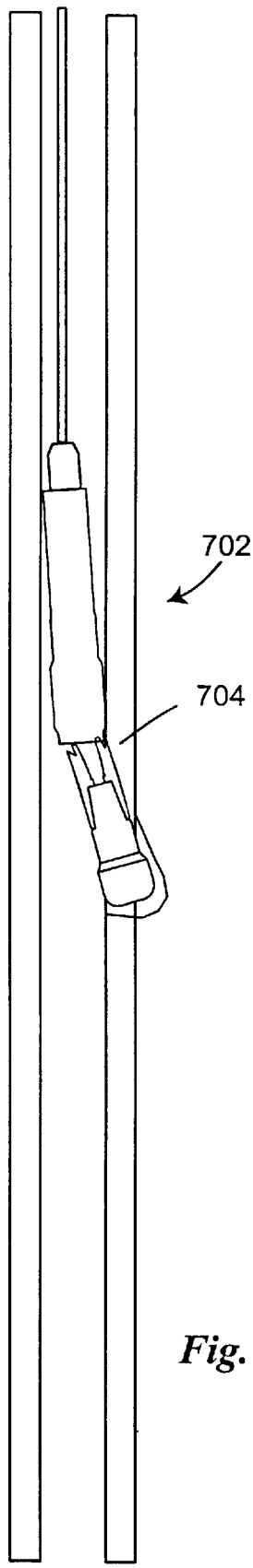

FIG. 7 shows the tool in a straight position. FIG. 8 and FIG. 9 shows the tool in a position whereby the second end has been deflected in the plane of the paper by moving the lever end 617 in the plane of the paper. If the lever end is moved back through and past its center position then the same deflection will be achieved, but 180 degrees rotated about the axis of first end 607. It will be appreciated that by deflecting the lever end 617 in and out of the plane of the paper similar results may be obtained in an orthogonal plane, and that by combining different amounts of orthogonal deflection, the lever end 617 and hence the second end 8 may be tilted in any direction relative to first end 607. FIG. 5 shows such a combined deflection in cross-section.

A first pair of parallel cammed surfaces 618 and 619 are provided on the protrusion 609 at the lever end 617. A corresponding first pair of cylindrical rollers 620 and 622 are carried on first link 623. Roller 620 bears on surface 618 and roller 622 bears on surface 619. As first link 623 moves axially within first end 607, the rollers and cams remain proximate. This ensures that there is a close correspondence between first link 623 position and the deflection of lever end 617 in the plane of the paper. Reaction forces will be such that only one at a time of rollers 618 and 620 bears a heavy load as the forces shift.

FIG. 6 shows first link 623 near its mid point of travel, where rollers 618 and 620 hold the lever end 617 centrally, and hence the second end 6 is straight in the plane of the paper. FIG. 3 shows first link 623 near one end of its travel, where rollers 618 and 620 hold the lever end 617 offset from the center line of first end 7, and hence the second end 6 is tilted in the plane of the paper.

FIG. 6 also shows a first electric motor 624 whose rotor 625 is extended by tube 626 to an externally threaded ring 627. First link 623 is internally threaded to engage with ring 627. When the first motor 624 is powered, it turns ring 627, thereby causing first link 623 to move axially back and forth according to the sense of motor rotation. Using linear position or rotation sensors such as potentiometers to monitor movement, the motor 624 may be controlled by well-known techniques to precisely position first link 623 and hence to precisely control deflection of second end 6 in the plane of the paper.

It will be appreciated that by forming second parallel cams on the lever end 617, rotated a quarter turn about the axis of the protrusion, a second link 628, externally threaded ring 629, motor 630 and rotor 631 may be used to effect deflection of second end 6 in the orthogonal to the plane of the paper. Rotor 631 and ring 629 rotate freely over extension tube 626.

It will further be appreciated that by co-ordinating the operation of first motor 624 and second motor 625, second end 608 may be tilted incrementally in any direction and with any bend within the mechanical limits of the assembly.

Electrical control of the motors may be effected from annular enclosure 632. This enclosure may be made self-contained by incorporating batteries and a communications sensor, such as a gauge to sense drilling fluid pressure or a magnetic pickup to sense drilling shaft rotation speed. As is well known in the art of drilling surveys, gravity-reading accelerometers may be used to measure the rotation from the vertical plane of a reference mark on first end 607. The direction of the second end 608 relative to the first end 607 may be measured using position sensors as aforementioned, and in conjunction with the accelerometer measurements may be used to set the second end 608 at any rotation from the vertical plane. This control, known as 'toolface control' is sufficient for many purposes and does not require azimuth input. Azimuth measurement using magnetometers requires extensive use of non-magnetic materials which may not be practical in the vicinity of the orientation sub and electric motors. It will be appreciated that this description of control is given for completeness but that there are many ways of controlling the motors to achieve the desired orientation, such as direct electrical connection to separate instrumentation 606 which may also contain azimuth sensors.

As is well known, the thread pitch on a screw may be chosen so that axial force on its mating nut will not cause unscrewing. Thus the thread on rings 627 and 629 can be chosen so that back-driving forces transmitted to links 623 and 628 cannot cause the rings 627 and 629 to rotate. Thus it can be arranged without further mechanisms and without constant motor correction that the orientation of second end 606 will remain unchanged when the motors are powered off. This is preferred for battery operated systems, but has the slight disadvantage that in the event of tool failure, the bend will remain set at its last position throughout retrieval to surface. Where natural closing is required, the thread pitch and cam angles will be chosen to allow back driving, so that when pulling out the assembly will have a tendency to straighten. It will be appreciated that back driving can then be resisted by continued use of electrical power to servo the motors or by other means.

While the foregoing description has used electrical motors and screws to effect cam movement, it will be appreciated that hydraulic force could be used, such as via hydraulic power fed through pipes from surface or using a downhole hydraulic pump. The cams may alternatively be replaced by radially pointing pegs running in short approximately helical slots cut in the wall of the lever end 617.

Alternative embodiments using the principles disclosed will suggest themselves to those skilled in the art, and it is intended that such alternatives are included within the scope of the invention, the scope of the invention being limited only by the claims.

What is claimed is:

1. A variable orientation downhole actuation tool disposed near the end of a down hole tube, including a first part having a respective axis and joined to the down hole tube whose orientation is fixed relative to the down hole tube, and a second part having a respective axis and fixed by articulation to the first part, whose orientation may be adjusted relative to the axis of the first part, the orientation of the second part being adjustable so as to vary a first angle included between the first part and the second part, a second angle through which the second part is rotated relative to the axis of the first part, and a third angle through which the second part is rotated about the axis of the second part, these three angles being independently adjustable, the articulation between the first part and the second part including:

a first actuating member capable of substantially axial movement relative to the first part, and a first following member, which the first actuating member bears against such that axial movement of the first actuating member causes a substantially transverse movement of the first following member, a second actuating member capable of substantially axial movement relative to the first part, and a second following member, which the second actuating member bears against such that axial movement of the second actuating member causes a substantially transverse movement of the second following member independently in an orthogonal direction to the transverse movement of the first following member.

2. A tool according to claim 1 wherein the first actuating member and first following member comprise a pair of concentric tubes, one tube having a radial protuberance that co-operates with a longitudinal groove in the other tube, the protuberance constrained to move in the groove in a direction at an angle to the axis of the drill string.

3. A tool according to claim 2 wherein the second actuating member and second following member comprise a pair of concentric tubes, one tube having a radial protuberance that co-operates with a longitudinal groove in the other tube, the protuberance constrained to move in the groove in a direction at an angle to the axis of the drill string.

4. A tool according to claim 2 wherein the actuating members and following members comprising three concentric tubes, the intermediate tube acting both as an actuating member and a following member.

5. A tool according to claim 1 wherein the first following member comprises an first opposing pair of surfaces provided on a shaft, the surfaces being inclined to the axis of the first part.

6. A tool according to claim 5 wherein the second following member comprises an second opposing pair of surfaces provided on the shaft, set at ninety degrees to the first pair of surfaces, the second pair of surfaces being inclined to the axis of the first part.

7. A tool according to claim 2 wherein the actuating members movement is controlled by electric motors.

8. A tool according to claim 1 wherein the first part and the second part include a through bore for the passage of fluids.

9. A tool according to claim 1 wherein rotary power means is provided for supplying mechanical rotary power to the tool.

10. A method of drilling borehole casings by means of a variable orientation downhole window forming tool according to claim 1 and further wherein the forming tool is run in hole with a closely fitting straight orientation and then a bend is set to bring the window forming tool into contact with a casing upon further advancement of the window forming tool.

11. A variable orientation drill comprising:

a down-hole tube receivable in a well and having a lower end;

a variable orientation tool at said lower end and including a first part secured to said lower end of said down-hole tube, an articulation secured to said first part and a second part secured to said articulation and adjustable independently of said first part to vary an angle included between said parts, an angle through which said second part is rotated relative to an axis of said first part and an angle through which said second part is rotated about an axis of the second part;

a drill bit on said second part and rotatable about a drill bit axis independently of orientation of said articulation; and a pair of axially movable members on said variable orientation tool each displacing respective follower members for independently displacing said second member relative to said first member in two mutually orthogonal transverse directions at said articulation.

* * * * *